United States Patent [19]

Allen

[11] 4,105,083

[45] Aug. 8, 1978

[54] LARGE DIAMETER DRILL BIT

[75] Inventor: James H. Allen, Lakewood, Calif.

[73] Assignee: Smith International, Inc., Newport Beach, Calif.

[21] Appl. No.: 804,881

[22] Filed: Jun. 9, 1977

[51] Int. Cl.[2] ..... E21C 13/02

[52] U.S. Cl. ..... 175/313; 175/340; 175/394; 51/267

[58] Field of Search ..... 175/96, 215, 310, 313, 175/319, 329, 339, 340, 394, 393; 299/18, 87, 56, 41; 51/177, 267

[56] References Cited

U.S. PATENT DOCUMENTS

| | | | |
|---|---|---|---|
| 3,360,061 | 12/1967 | Canalizo | 175/215 X |
| 3,384,191 | 5/1968 | Schumacher et al. | 175/340 |
| 3,709,308 | 1/1973 | Rowley et al. | 175/329 |
| 3,951,220 | 4/1976 | Phillips, Jr. et al. | 175/393 |

*Primary Examiner*—Ernest R. Purser
*Assistant Examiner*—Nick A. Nichols, Jr.
*Attorney, Agent, or Firm*—Robert M. Vargo

[57] ABSTRACT

A drill bit is disclosed for drilling large diameter shafts. The drill bit comprises a main bit body having a plurality of rolling cutters rotatively mounted thereon. The cutters function to contact and disintegrate the earth formations at the bottom of the shaft thereby creating rock chips or cuttings. Water or drilling mud is pumped down the shaft and across the face of the main bit body for cooling the drill bit and for flushing the chips away from the shaft bottom. An auxiliary flow enhancer is attached beneath the main bit body for increasing the radial flow velocity of the drilling mud across the face of the bit body in order to remove the chips more efficaciously. The flow enhancer comprises a shaft mounted impeller such as a screw conveyor, a spiral brush, or a paddle-blade configuration. The shaft of each device is attached radially on the main bit body with each shaft having a drive wheel mounted thereon adjacent the bit body periphery. A radial flexible skirt extending to the hole bottom is attached beneath the main bit body on the trailing side of the flow enhancer in order to create a channel for the fluid flow. The drive wheel is adapted to contact and ride on the shaft bottom in order to drivingly rotate the conveyor, brush or paddle-blade, which in turn imparts a driving force on the drilling fluid along the flow channel.

15 Claims, 9 Drawing Figures

LARGE DIAMETER DRILL BIT

BACKGROUND OF THE INVENTION

1. Field of the Invention

The present invention relates generally to the art of drilling large diameter shafts in the earth and, more particularly, to the cleaning of the shaft bottom during the drilling operations.

2. Description of the Prior Art

Large diameter shafts are basically utilized in the mines for rescue, ventilation, ore and coal hoisting, and general access purposes. In recent years, large diameter shafts have been utilized for emplacing nuclear devices.

Large diameter shafts are usually drilled with rotary flat bottom bits which comprise a main bit body having a plurality of rotatively supported roller cutters attached thereto. The cutters function to contact and disintegrate the earth formation at the bottom of the shaft, thereby creating cuttings or chips at that location.

Various circulation systems utilizing water or drilling mud have been used to flush the earth cuttings away from the shaft bottom. Such circulation systems are usually classified as either direct or reverse circulating systems. In the direct circulating systems, drilling fluid is pumped down the center drill column, across the face of the drill bit at the bottom of the shaft, and up through the annulus of the shaft. In the reverse circulating systems, the drilling fluid is pumped down the shaft annulus to the bottom of the shaft, across the face of the drill bit and up through the center drill column back to the surface. In both systems, when the drilling fluid transporting the chips and cuttings reaches the surface, the fluid is usually pumped through various separating and cleaning devices to separate the cuttings, silt, gas and other materials from the drilling fluid in order to enable the cleaned drilling fluid to be recycled for further use.

Although present big hole rotary drilling systems work adequately, present day systems have several shortcomings which impair their performance. One major shortcoming is that present day circulating systems are inefficient for transporting the drilled cuttings across the bottom of the shaft and away from the cutting action of the drill bit. As a result, the rock chip cuttings are reground before being removed from under the bit. It has been determined that the regrinding of these chips to a fine size requires large amounts of energy, decreases the penetration rate, and decreases the life of the cutters.

SUMMARY OF THE INVENTION

The present invention obviates the above-mentioned shortcomings by providing a large diameter drill bit having an improved bottom hole cleaning system.

In its broadest aspect, the present invention pertains to a large diameter drill bit comprising a main bit body having a plurality of roller cutters mounted thereon. A circulation system is providing for pumping drilling fluid across the face of the main bit body. The main bit body further includes a central opening for allowing drilling fluid to pass therethrough, and an auxiliary flow enhancer for increasing the radial flow velocity of the drilling fluid across the face of the bit body.

In three embodiments, the auxiliary flow enhancer comprises a shaft supported helical impeller rotatively mounted along the radius of the main bit body and a drive mechanism mounted on the shaft near the periphery of the main bit body for rotatively driving the helical impeller.

In another embodiment, the auxiliary flow enhancer comprises a plurality of paddle-blades mounted on a rotating shaft.

In each embodiment, a flexible skirt, extending to the hole bottom, is attached to the main bit body on the trailing side of the impeller. The flexible skirt functions to form a channel for the fluid flow along the axis of the impeller.

A primary advantage of the present invention is that larger cuttings, normally not movable in fluid suspension, can now be more efficiently driven across the face of the main bit body. As a result, less recutting and regrinding of the larger cuttings occurs. This results in an increase in the penetration rate, an increase in the life of the cutters, and a reduction of required energy input.

The features of the present invention, which are believed to be novel, are set forth with particularity in the appended Claims. The present invention, both as to its organization and manner of operation, together with the further advantages thereof, may best be understood by reference to the following description taken in connection with the accompanying drawings.

DESCRIPTION OF THE PREFERRED EMBODIMENTS

Figure 1:
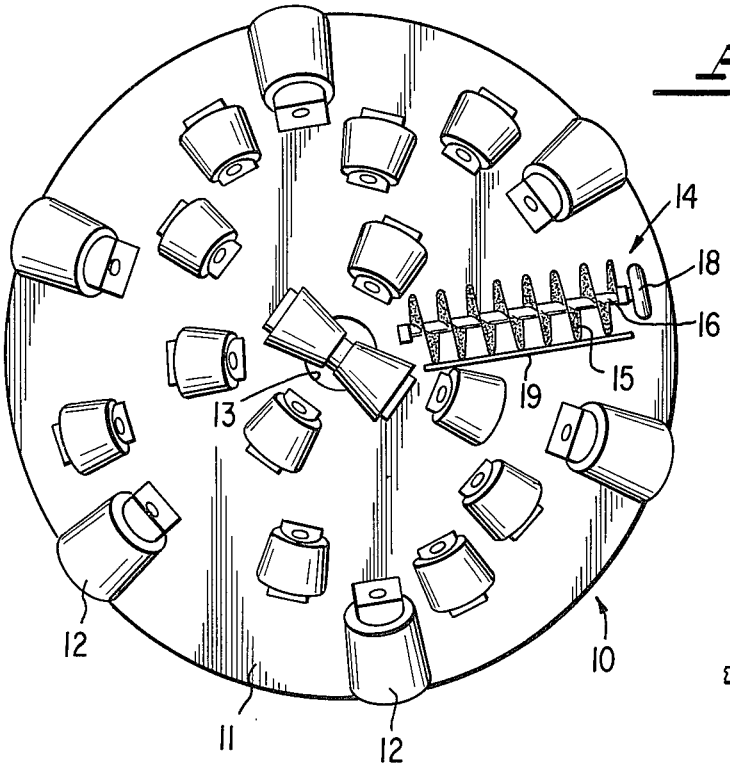
FIG. 1 is a bottom plan view of a large diameter drill bit having a flow enhancer in accordance with the present invention.
Figure 2:
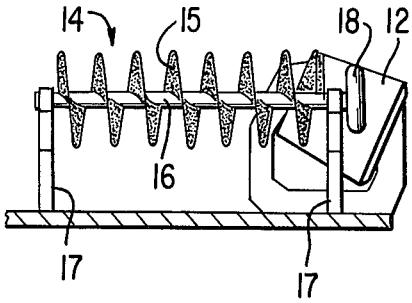
FIG. 2 is a fragmentary elevational view of the flow enhancer in which the flow enhancer utilizes a helical brush impeller.

Referring now to the drawings, FIGS. 1 and 2 illustrate the first embodiment of the present invention comprising a large diameter drill bit generally indicated by arrow 10, comprising a main bit body 11 having a plurality of roller cutters 12 rotatively mounted thereon. The cutters 12 are conventional in structure and can have either milled teeth disc or tungsten carbide inserts mounted thereon for contacting and disintegrating the earth formation at the bottom of the shaft. A central opening 13 is provided on the main bit body 11 which communicates with the interior of the drill column.

In the preferred embodiment, the drill bit 10 is designed to be utilized with reverse circulating systems, i.e. the drilling fluid is pumped down the annulus of the shaft, inwardly across the face of the drill bit 10, and up through the central opening 13 and the interior of the drill column. While crossing the face of the drill bit 10, the drilling fluid mixes with the rock chips in order to carry the chips away from the drill bit face and up through the central opening 13.

In order to increase the flow of drilling fluid across the face of the drill bit 10, a flow enhancer, generally indicated by arrow 14, is provided. The flow enhancer 14 comprises a helical brush 15 mounted on a shaft 16. A pair of legs 17 are attached to the main bit body 11 for rotatively supporting the shaft 16. The helical brush 15 is radially oriented on the face of the drill bit 10 and is adapted to extend beyond the cutting plane to contact the bottom of the shaft. The helical brush 15 bristles can be made from steel or other metals, or polypropylene, polyethylene or other similar synthetic materials.

A drive wheel 18 is also mounted on the shaft 16 adjacent the periphery of the main bit body 11. The drive wheel 18 is adapted to contact and roll along the bottom of the shaft in order to drivingly rotate the helical brush 15. The drive wheel 18 is mounted adjacent the bit periphery where the linear velocity is maximum.

A skirt 19 extending to the hole bottom is attached beneath the main bit body 11 on the trailing side of the helical brush 15 in order to create a channel for the fluid flow along the helical brush axis.

Figure 3:
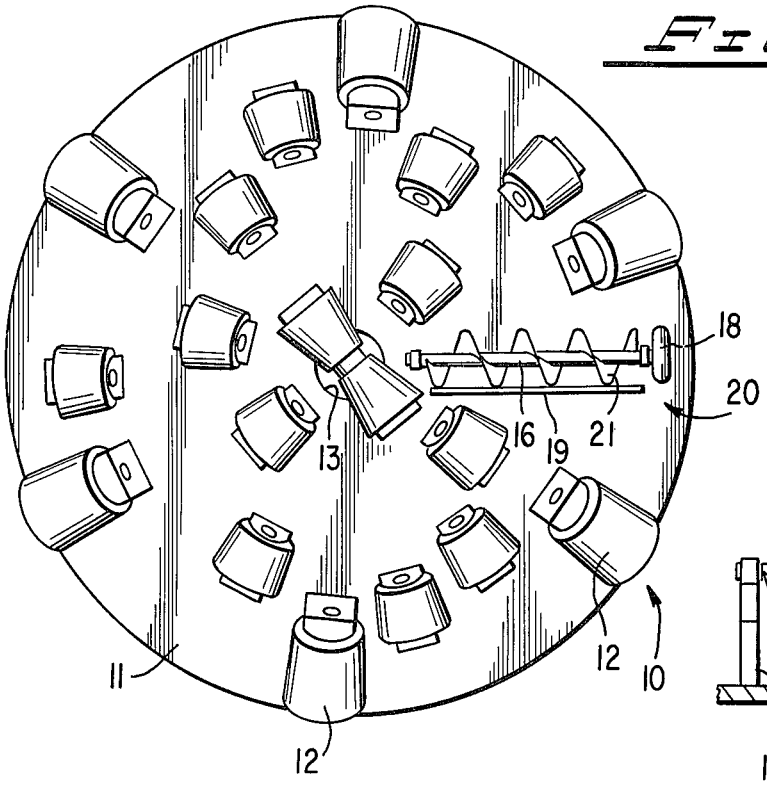
FIG. 3 is a bottom plan view of the second embodiment of the present invention in which a screw conveyor is utilized as the impeller in the flow enhancer.
Figure 4:
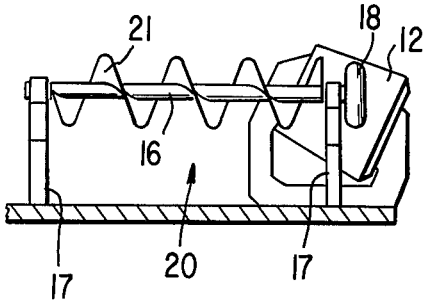
FIG. 4 is a fragmentary elevational view of the screw conveyor flow enhancer.

Referring now to FIGS. 3 and 4, the drill bit 10 includes components similar to those described in FIGS. 1 and 2 and like numerals denote like components. The drill bit 10 further includes a second embodiment of the flow enhancer, generally indicated by arrow 20.

In this embodiment, a metal screw conveyor 21 is utilized as the impeller. The screw conveyor 21 is supported in a similar manner as the helical brush 15 except that the conveyor 21 does not extend beyond the cutting plane to contact the shaft bottom. Because the conveyor 21 is metal, a clearance is provided with the shaft bottom.

Figure 5:
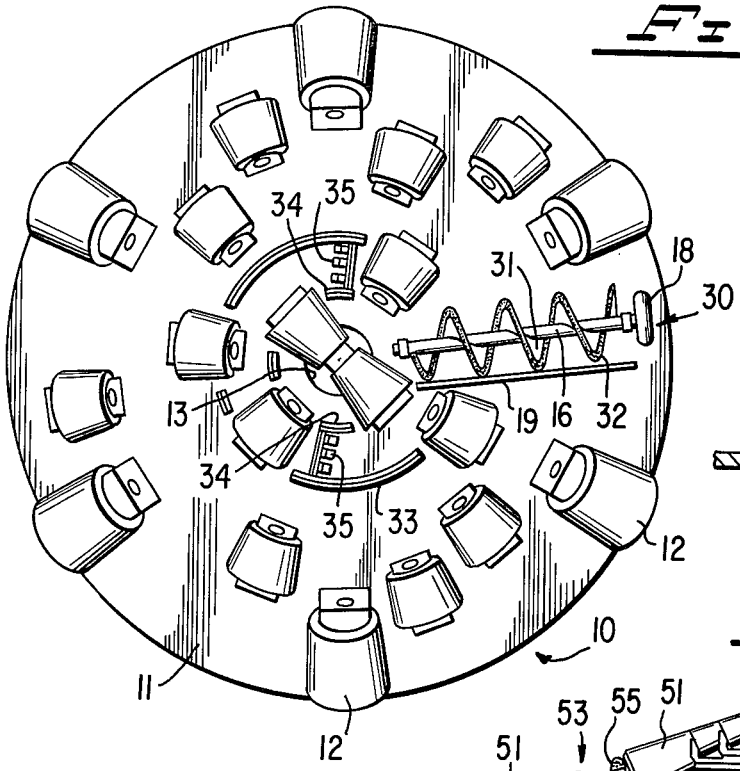
FIG. 5 is a bottom plan view of the third embodiment of the present invention in which a combination screw-brush conveyor is utilized as the flow enhancer impeller.
Figure 6:
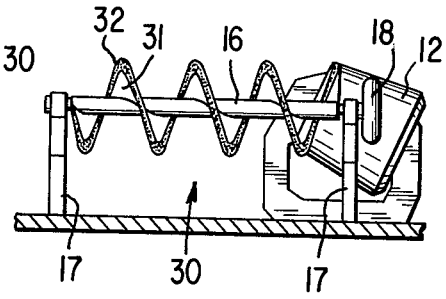
FIG. 6 is a fragmentary elevational view of the screw-brush conveyor flow enhancer.

FIGS. 5 and 6 illustrate the third embodiment of the flow enhancer, generally indicated by arrow 30, which includes a combined helical screw-brush assembly as the impeller. In this assembly, a helical conveyor 31 is mounted on the shaft 16 and the brushes 32 are attached to the outer edges of the conveyor 31. In this combination, the conveyor 31 does not extend beyond the cutting plane of the drill bit but the brushes 32 do, in order to contact the surface of the shaft bottom.

Besides having a straight flexible wall skirt 19 extending along the axis of the impeller, the drill bit 10 further includes a pair of annular skirts 33 and 34 which are circumferentially spaced about the center opening 13.

The annular skirts 33 and 34 function to form an enclosure for the drilling fluid which has moved across the face of the drill bit 10 to the central portion thereof.

A plurality of radially oriented flaps 35 are positioned between the skirts 33 and 34. These flaps 35 are flexible and are adapted to extend below the cutting plane of the drill bit body 11 to contact the surface of the shaft bottom.

Figure 7:
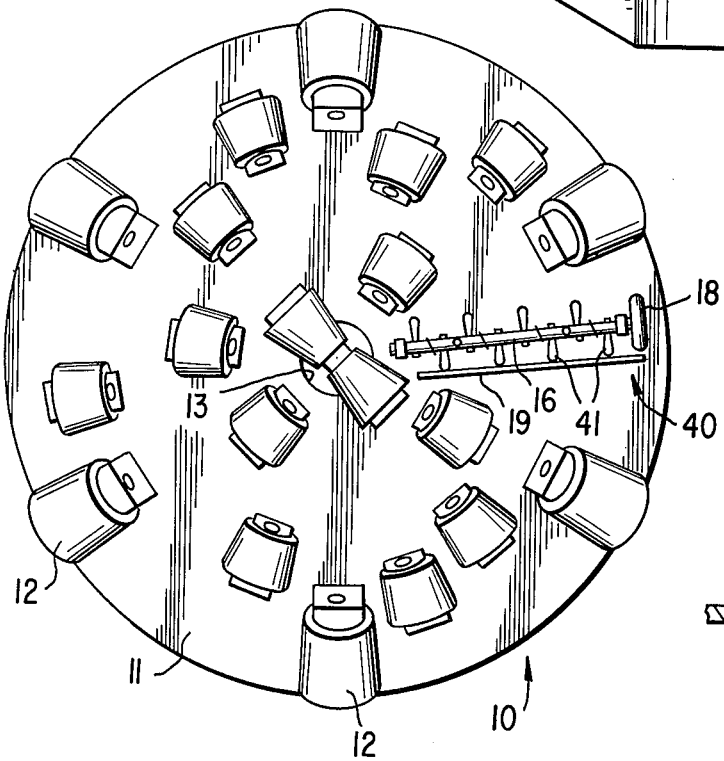
FIG. 7 is a bottom plan view of a fourth embodiment of the present invention in which a plurality of shaft mounted paddle-blades are utilized as the impeller in the flow enhancer.
Figure 8:
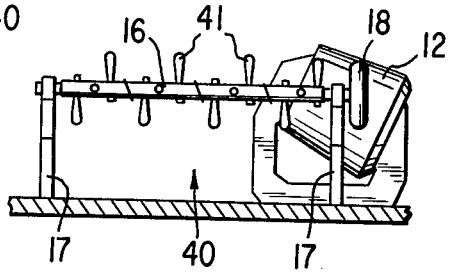
FIG. 8 is a fragmentary elevational view of the paddle-blade configuration.

FIGS. 7 and 8 illustrate a fourth embodiment of the flow enhancer, generally indicated by arrow 40, in which a paddle-blade assembly is utilized as the impeller. The paddle-blades 41 are shaped like air foils pitched to create a flow in a radially inward direction.

Figure 9:
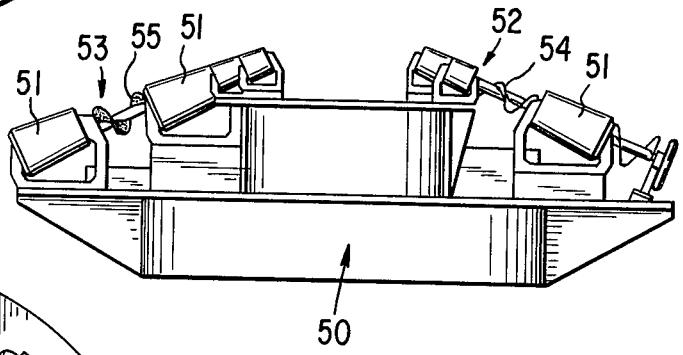
FIG. 9 is an elevational view of a fifth embodiment of the present invention in which the rolling cutters and the flow enhancers are mounted on a bias on the main bit body.

FIG. 9 illustrates a modification of the drill bit body, generally indicated by arrow 50, in which the roller cutters 51 are mounted on a bias instead of a single plane.

In this embodiment, the drill bit body 50 also supports a pair of flow enhancers 52 and 53 which are also mounted on a bias adjacent the cutting plane of the drill bit. The flow enhancer 52 includes an impeller 54 similar to the conveyor 21 of FIGS. 3 and 4 while the flow enchancer 53 includes an impeller 55 similar to the helical screw-brush assembly 31 and 32 of FIGS. 5 and 6. Similarly the impeller 55 extends beyond the cutting plane of the drill bit to contact the surface of the shaft bottom.

OPERATION

In each of the embodiments, the drill bit 10 is rotated via the drill column and the roller cutters 12 contact and disintegrate the earth formation at the shaft bottom. The reverse circulation system concurrently functions to pump the drilling fluid down the annulus of the shaft, inwardly across the face of the main bit body 11 and up through the central opening 13 and the interior of the drill column. The impeller of each of the flow enhancers 14, 20, 30, or 40 is rotatively driven by the drive wheel 18. As the main bit body 11 rotates, the drive wheel 18 is adapted to contact and roll along the surface of the shaft bottom. This rolling motion imparts rotation to the shaft 16. Although not shown, the support legs 17 can include a spring or other flexible connection to improve the drive wheel contact with the shaft bottom surface. Moreover, a gear train or other transmission means can be connected between the drive wheel 18 and the shaft 16 to obtain a rotary speed differential.

Upon rotation, each of the various impellers of the flow enhancers functions to pump the drilling fluid along its axis and the skirt 19, located on the trailing side of the impeller, functions to provide a flow channel for the drilling fluid radially from the periphery of the main bit body 11 to the central opening 13. By having this auxiliary pumping action, the flow across the bottom of the shaft is increased, thereby enabling the drilling fluid to more efficiently transport the rock chips across the shaft face, before they are wastefully reground to smaller sizes.

It should also be noted that the brushes on the impellers 15 and 32 contact the surface of the shaft bottom to help dislodge the partially impacted rock chips. This eliminates the need for further cutter action and taken with a more efficient rock chip flow, results in a longer life for the cutters 12 and in an improved rate of penetration.

It should be noted that various modifications can be made to the assembly while still remaining within the purview of the following claims.

What is claimed is:

1. A rotary drill bit, adapted for connection with a drill column, for drilling large diameter shafts in the earth comprising;

a main bit body having a face across which drilling fluid is adapted to flow and a central opening adapted for communication with the interior of the drill column for enabling drilling fluid to pass therethrough;

a plurality of cutters mounted on the face of said main bit body forming a cutting plane for contacting and disintegrating the earth formation at the shaft bottom; and means radially positioned on the face of said main bit body for enhancing the flow of drilling fluid across the face of said main bit body, said flow enhancing means includes an axial flow impeller rotating about an axis positioned on the radius of said main bit body.

2. The combination of claim 1 further including a wall portion attached to the main bit body face adjacent said flow enhancing means on the trailing side thereof, said wall portion extending to the cutting plane for forming a channel for the fluid flow passing through said flow enhancing means.

3. The combination of claim 2 further including drive means for rotatively driving said axial flow impeller.

4. The combination of claim 3 wherein said axial flow impeller is mounted on a shaft and said drive means includes a drive wheel secured on said shaft, the periphery of said drive wheel extending to said cutting plane in order to contact the surface of the shaft bottom and have a rotary motion imparted thereto.

5. The combination of claim 4 wherein said drive wheel is mounted adjacent the periphery of said main bit body.

6. The combination of claim 2 further comprising a skirt attached to the main bit body face at least partially about the circumference of the central opening of the main bit body.

7. The combination of claim 2 wherein said wall portion is made of a flexible material.

8. The combination of claim 1 wherein said axial flow impeller comprises a helical brush mounted on a shaft.

9. The combination of claim 8 wherein the outer edges of said helical brush bristles extend beyond the cutting plane of the cutters to contact the surface of the shaft bottom.

10. The combination of claim 8 wherein said brush bristles are made of a synthetic flexible material.

11. The combination of claim 1 wherein said axial flow impeller comprises a screw conveyor mounted on a shaft.

12. The combination of claim 11 wherein the outer edges of said screw conveyor extend within the cutting plane of the cutters to provide a clearance with the surface of the shaft bottom.

13. The combination of claim 1 wherein said axial flow impeller comprises a screw conveyor mounted on a shaft and a quantity of brush bristles attached to the outer edges of said screw conveyor.

14. The combination of claim 13 wherein said brush bristles extend beyond the cutting plane of said cutters to contact the surface of the shaft bottom.

15. The combination of claim 1 wherein said axial flow impeller comprises a plurality of paddle-blades mounted on a shaft, each paddle-blade being pitched to provide for an axial flow.

* * * * *